US006129395A

United States Patent [19]

Schlesener et al.

[11] Patent Number: 6,129,395

[45] **Date of Patent: *Oct. 10, 2000**

[54] SPRING LATCH FOR A PORTABLE COMPUTER

[75] Inventors: Maria Carmen Schlesener, Pflugerville; Mark Ganninger, Round Rock, both of Tex.

[73] Assignee: Dell USA, L.P., Round Rock, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/063,523

[22] Filed: Apr. 21, 1998

[51] Int. Cl.[7] ..... E05C 19/10

[52] U.S. Cl. ..... 292/128; 292/102; 292/242; 292/228; 292/303; 292/DIG. 61; 361/683

[58] Field of Search ..... 292/125, DIG. 38, 292/DIG. 37, DIG. 61, 128, 102, 107, 108, 242, 241, 240, 228, 198, 203, 209, 303; 361/683; 220/326

[56] References Cited

U.S. PATENT DOCUMENTS

| | | | |
|---|---|---|---|
| 3,100,980 | 8/1963 | Humphries | 292/128 |
| 3,425,587 | 2/1969 | Duross, Jr. | 220/326 |
| 4,344,646 | 8/1982 | Michel | 292/87 |
| 4,363,403 | 12/1982 | Raucci, Jr. et al. | 206/387 |
| 4,478,005 | 10/1984 | Mundschenk | 49/388 |
| 4,630,852 | 12/1986 | White et al. | 292/87 |
| 4,774,973 | 10/1988 | Gueret | 220/326 |
| 4,901,882 | 2/1990 | Goncalves | 220/324 |
| 5,044,810 | 9/1991 | Matsuoka et al. | 403/93 |
| 5,106,132 | 4/1992 | Bako et al. | 292/128 |
| 5,198,966 | 3/1993 | Kobayashi et al. | 361/395 |
| 5,567,545 | 10/1996 | Murakami | 429/163 |
| 5,580,107 | 12/1996 | Howell | 292/95 |
| 5,689,824 | 11/1997 | Nagai | 455/89 |
| 5,754,397 | 5/1998 | Howell et al. | 361/686 |
| 5,785,398 | 7/1998 | Park | 312/223.2 |

FOREIGN PATENT DOCUMENTS

| | | | |
|---|---|---|---|
| 403025180 | 2/1991 | Japan | 292/228 |

*Primary Examiner*—B. Dayoan
*Assistant Examiner*—Clifford B Vaterlaus
*Attorney, Agent, or Firm*—Haynes and Boone, LLP

[57] ABSTRACT

A laptop computer includes a base member and a lid member pivotally attached to the base member. A latch member is mounted in the lid member. The latch member includes a top, a bottom, and opposite sides. A hook member protrudes from the top of the latch member. A spring retaining member is positioned adjacent the bottom of the latch member. A pair of flexible snap-in members are positioned on the opposite sides. A first one of the flexible snap-in members is positioned on a first one of the sides and a second one of the flexible snap-in members is positioned on a second one of the sides. The spring retaining member is positioned between the flexible snap-in members. The base member includes a receiver for receiving the hook member.

7 Claims, 5 Drawing Sheets

SPRING LATCH FOR A PORTABLE COMPUTER

BACKGROUND

The disclosures herein relate generally to portable computers and more particularly to a spring latch for latching and unlatching a laptop cover and a laptop base. Portable laptop or notebook computers typically include a base and a pivotally attached lid which is connected to the base by a hinge. The lid and base latch together when the lid is closed or nested on the base. When unlatched, the lid is rotated open thus exposing a keyboard on the base and an LCD panel mounted in the lid.

The latch which secures the base and lid in the closed position is typically mounted in the lid adjacent an edge of the LCD panel. As a result, the amount of space available for the latch is limited. A standard latch device slides to one side to disengage, and back to its normal position to engage to the receiver on the base. The standard latch is typically comprised of a plastic latch member, a compression spring or springs, locking snap features located in the plastic latch member and the lid plastic back housing, and travel ribs located on the lid plastic back housing to guide the latch in the side to side motion. The standard latch device needs ample space for the snap and guide features, which currently cannot be used in present designs when latch space is limited. With limited space available, a rotating latch device can be used instead of the standard latch. The rotating latch is typically a spring latch device comprising a plastic latch member, a metal rod mounted in the latch member, and a torsion spring. The metal rod functions to attach the latch member to the lid and also receives the torsion spring.

The metal rod is inserted into or press-fit onto the latch member. The torsion spring surrounds the metal rod, and the latch member pivots about the rod acting against a spring force imposed by the torsion spring. The spring engages the latch member and the housing for support. The latch member rotates approximately 5.6 degrees to engage a receiver in a palmrest portion of the base and then rotates or snaps back to an at rest position in order to latch or lock the lid and base together. Actually, the latch member is capable of rotating more than the five degrees required for latching or unlatching.

Presently, however, the spring force is not enough for the system to latch properly. The torsion spring provides only about 0.13 lbf of force which is too weak to maintain the lid and base latched together. Thus, a greater spring force would permit the latch to function as intended.

Therefore, what is needed is a latch member which is small enough to be mounted in the lid of a laptop computer and strong enough to maintain the lid and base of the computer engaged when the lid is closed. It would also be beneficial to provide such a latch member which is durable and reliable and is easily installed and removed for manufacturability, and for repairs and replacement.

SUMMARY

One embodiment, accordingly, provides a latch member which is sufficiently small enough to be useable in the lid of a laptop computer, which is easy to install during manufacturing and easy to replace, should repair become necessary, which, despite the small size, has a spring force sufficient to maintain the laptop lid and laptop base engaged, and which is durable and reliable. To this end, a latch apparatus is provided having a latch member including a top, a bottom, and opposite sides. A hook member is provided to protrude from the top of the latch member. A spring retaining member is positioned adjacent the bottom of the latch member. A pair of flexible snap-in members are also provided. A first one of the flexible snap-in members is positioned on a first one of the sides, and a second one of the flexible snap-in members is positioned on a second one of the sides. The spring retaining member is positioned between the flexible snap-in members.

A principal advantage of this embodiment is that a latch member, small enough to be mounted in the lid of a laptop computer adjacent the LCD, is easily snapped into and out of the lid. The latch member retains a spring member which is durable, reliable and has a spring force sufficient to maintain the laptop lid and base engaged, and is easily releasable by the application of manual pressure when the laptop lid is to be opened.

DETAILED DESCRIPTION OF THE PREFERRED EMBODIMENT

Figure 1:
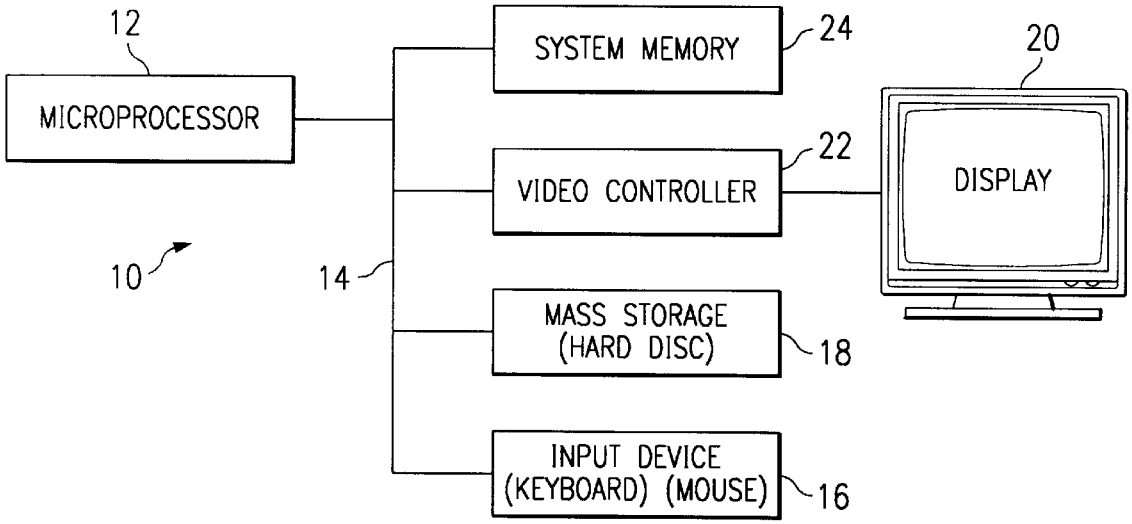
FIG. 1 is a diagrammatic view illustrating an embodiment of a computer system.

In one embodiment, computer system 10, FIG. 1, includes a microprocessor 12, which is connected to a bus 14. Bus 14 serves as a connection between microprocessor 12 and other components of computer system 10. An input device 16 is coupled to microprocessor 12 to provide input to microprocessor 12. Examples of input devices include keyboards, touchscreens, and pointing devices such as mouses, trackballs and trackpads. Programs and data are stored on a mass storage device 18, which is coupled to microprocessor 12. Mass storage devices include such devices as hard disks, optical disks, magneto-optical drives, floppy drives and the like. Computer system 10 further includes a display 20, which is coupled to microprocessor 12 by a video controller 22. A system memory 24 is coupled to microprocessor 12 to provide the microprocessor with fast storage to facilitate execution of computer programs by microprocessor 12. It should be understood that other busses and intermediate circuits can be deployed between the components described above and microprocessor 12 to facilitate interconnection between the components and the microprocessor.

Figure 2:
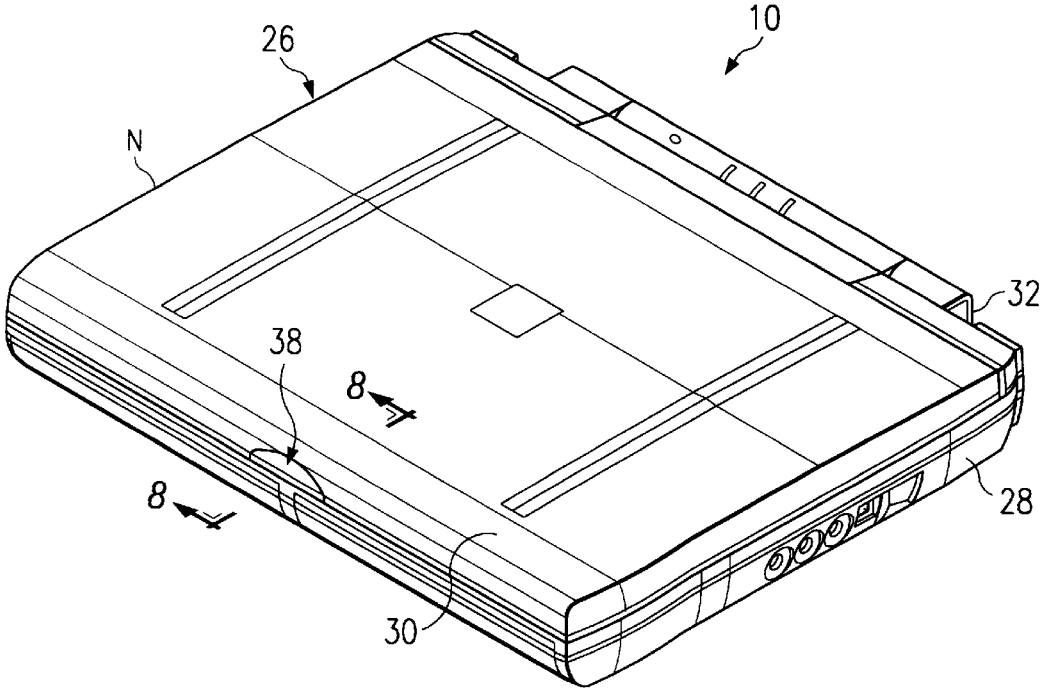
FIG. 2 is an isometric view illustrating an embodiment of a portable computer including a lid in a closed position.

Computer system 10 is self-contained in a typical portable computer, i.e. a laptop or notebook type such as that generally designated in FIG. 2. Laptop computer 26 comprises a base 28 and a lid 30 which are pivotally interconnected at a hinge 32. Lid 30 is movable between a nested position N, wherein lid 30 is engaged with base 28, and an open position O, FIG. 3, wherein lid 30 is pivoted out of engagement with base 28. In the open position, O, an LCD panel 36 mounted in lid 30 is exposed and a keyboard 34 mounted in base 28 is also exposed.

Figure 3:
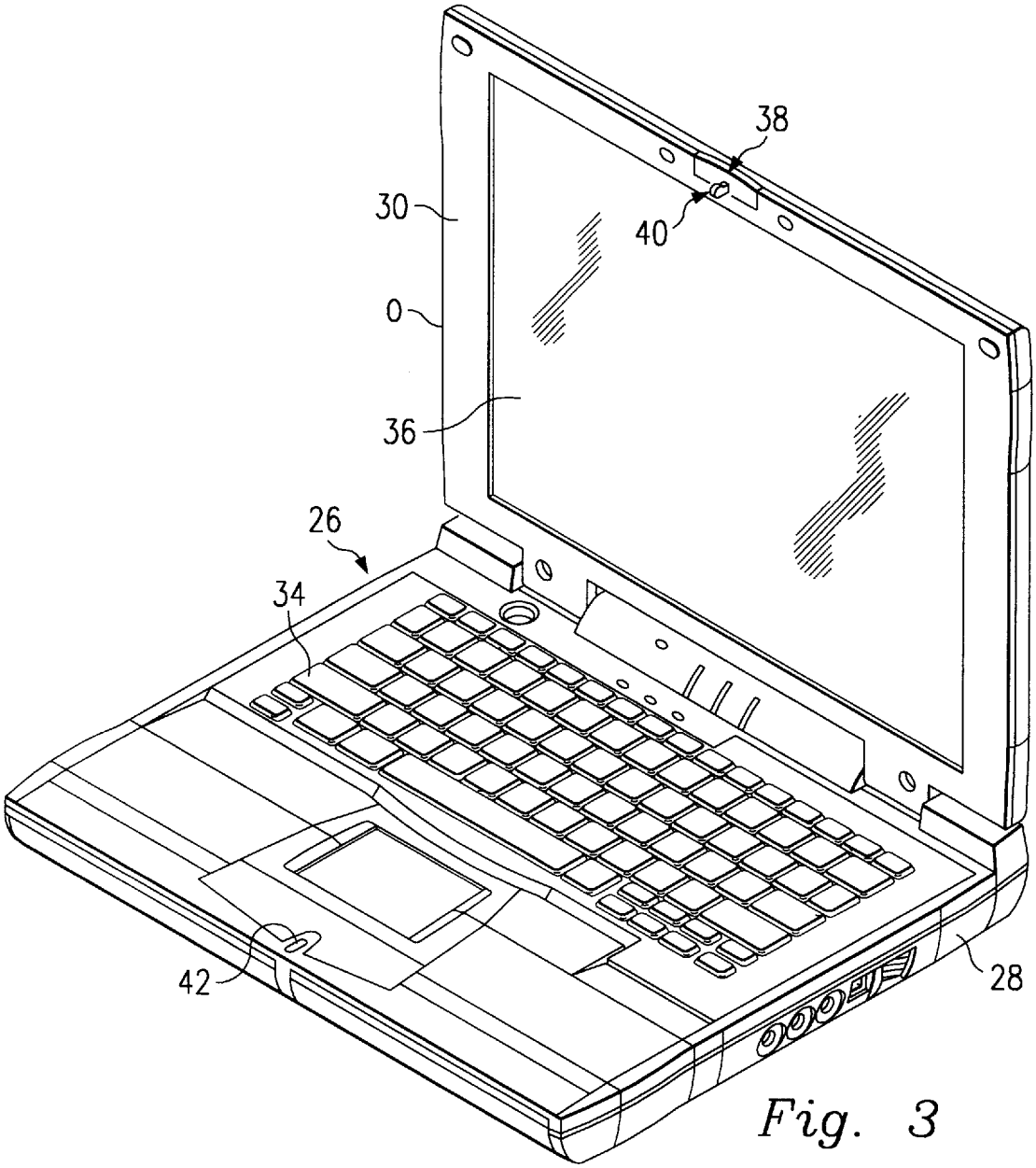
FIG. 3 is an isometric view illustrating an embodiment of the portable computer including the lid in an open position.

In order to maintain lid 30 engaged with base 28, in the nested position N, FIG. 2, a latch 38, preferably formed of a suitable plastic, is required. As illustrated in FIG. 3, latch 38 is dimensionally limited due to the fact that the latch 38 is mounted in lid 30 adjacent LCD panel 36. Latch 38 is spring biased (as is discussed below) and includes a hook member 40, FIG. 3 which extends to engage a receiver 42 formed in base 28. Hook member 40, FIG. 4, includes a cammed or sloped surface 41, permitting hook member 40 to slide into receiver 42, and includes a ledge 39 to limit unintentional withdrawal of hook 40 from receiver 42.

Latch 38 is mounted in lid 30, and includes a pressure surface 43, a top portion 44, a bottom portion 46, and opposite sides 48*a* and 48*b*. The hook member 40 extends or protrudes from top portion 44. A spring retaining member 50 is positioned adjacent bottom portion 46 of latch 38. A pair of flexible snap-in members, 52*a*, 52*b*, are positioned on the sides 48*a*, 48*b*. A first one of the snap-in members 52*a* is positioned on a first one of the sides 48*a*, and a second one of the snap-in members 52*b* is positioned on a second one of the sides 48*b*. Spring retaining member 50 is positioned between and extends transverse to the snap-in members 52*a*, 52*b*.

The flexible snap-in members 52*a*, 52*b* are provided by forming a pair of grooves 56*a*, 56*b* in a portion of a front face 54 adjacent sides 48*a*, 48*b*, thus permitting flexibility of the snap-in members 52*a*, 52*b* which extend substantially parallel to each other. A reinforcing rib 58 also extends transversely between sides 48*a*, 48*b* and protrudes from front face 54.

Figure 4:
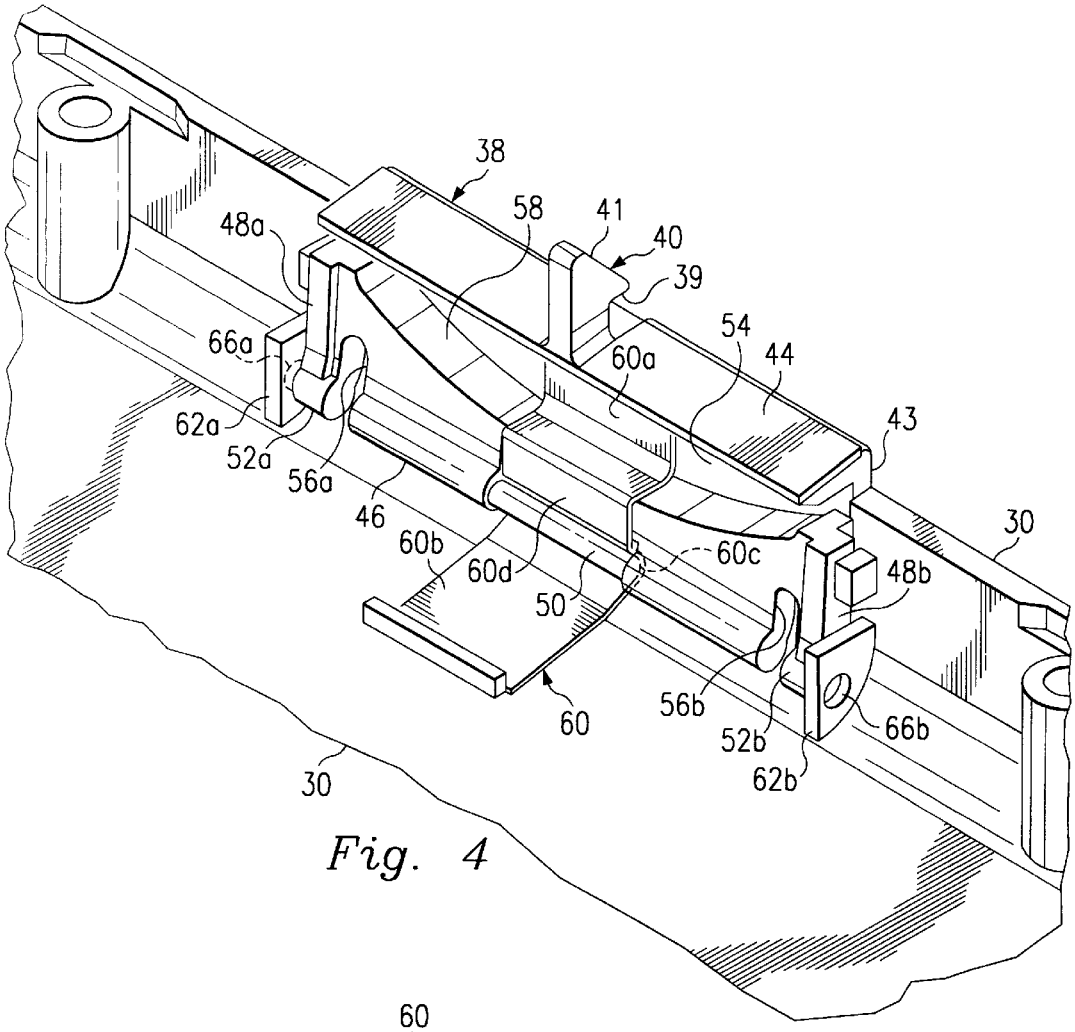
FIG. 4 is a partial isometric view illustrating an embodiment of a latch mounted in the lid.
Figure 6:
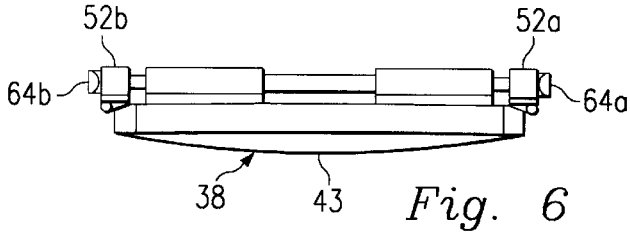
FIG. 6 is a bottom view illustrating an embodiment of the latch.

Latch 38, FIG. 4, snaps into lid 30 by means of flexible snap-in members 52*a*, 52*b* engaging latch mounts 62*a* and 62*b*, formed in lid 30 which is preferably formed of a suitable plastic material. This is accomplished by providing buttons 64*a* and 64*b*, FIG. 6, on each of the snap-in members 52*a*, 52*b*, respectively. latch mounts 62*a*, 62*b*, FIG. 4, each include an aperture 66*a*, 66*b*, respectively formed therein, for receiving a respective one of the buttons 64*a* and 64*b*.

Figure 5:
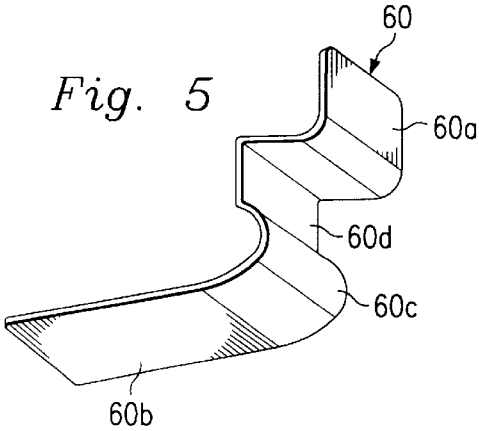
FIG. 5 is an isometric view illustrating an embodiment of a spring for use with a latch.

A spring member 60 is, preferably formed of a suitable spring steel, FIG. 5, and includes a first portion 60*a*, a second portion 60*b* and an intermediate portion 60*c* therebetween. The first portion 60*a* is engaged adjacent the front face 54 and the second portion 60*b* is formed at generally a right angle to the first portion 60*a*. Also a rib engaging portion 60*d* is formed in first portion 60*a*.

Again in FIG. 4, it can be seen that spring 60 is retained in latch 38 by engaging spring retaining member 50 in intermediate portion 60*c* and by seating reinforcing rib member 58 in rib engaging portion 60*d*. In this position, first portion 60*a* of spring 60 engages front face 54 of latch 38, and, when latch 38 is mounted in lid 30, second portion 60*b* of spring 60 engages lid 30.

Figure 7:
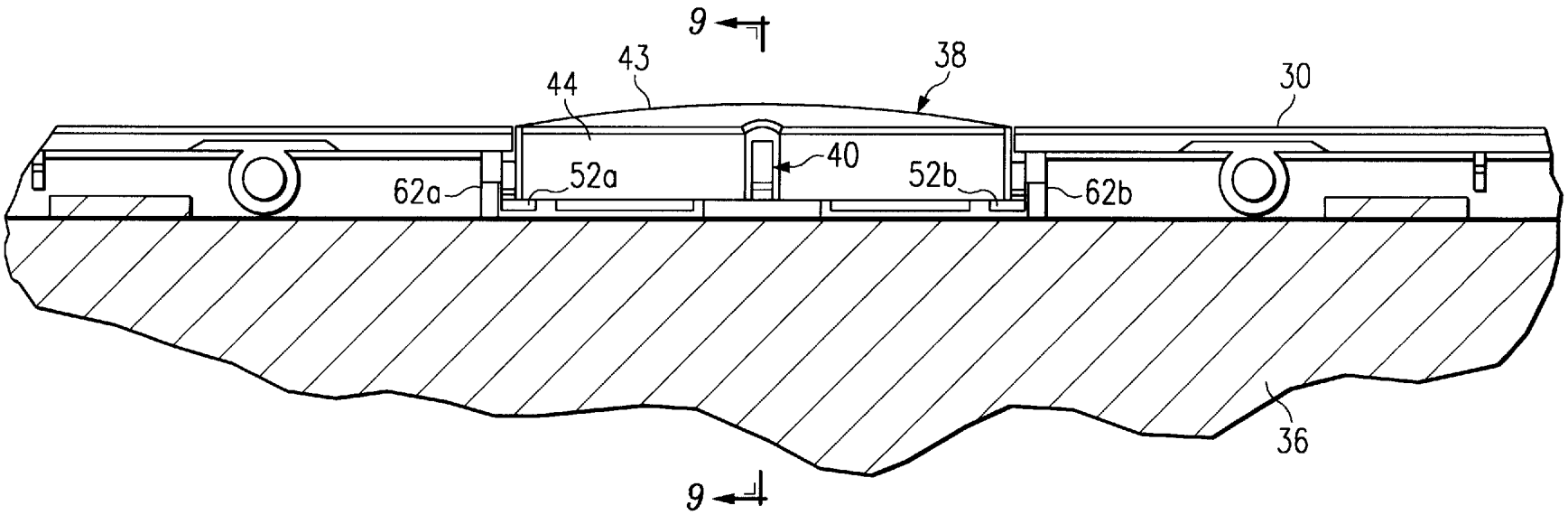
FIG. 7 is a partial plan view illustrating an embodiment of the latch mounted in the lid.
Figure 8:
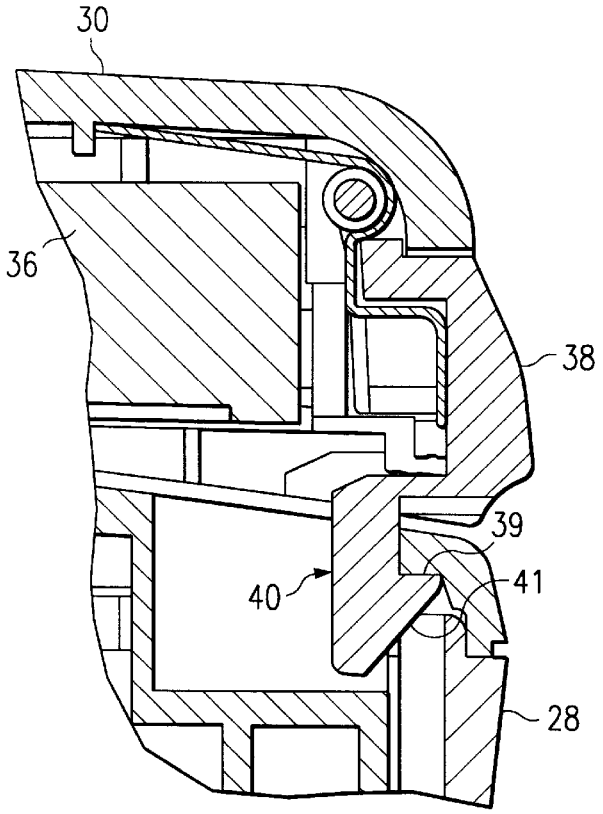
FIG. 8 is a partial cross-sectional view of the latch taken along the line 8—8 of FIG. 2.
Figure 9:
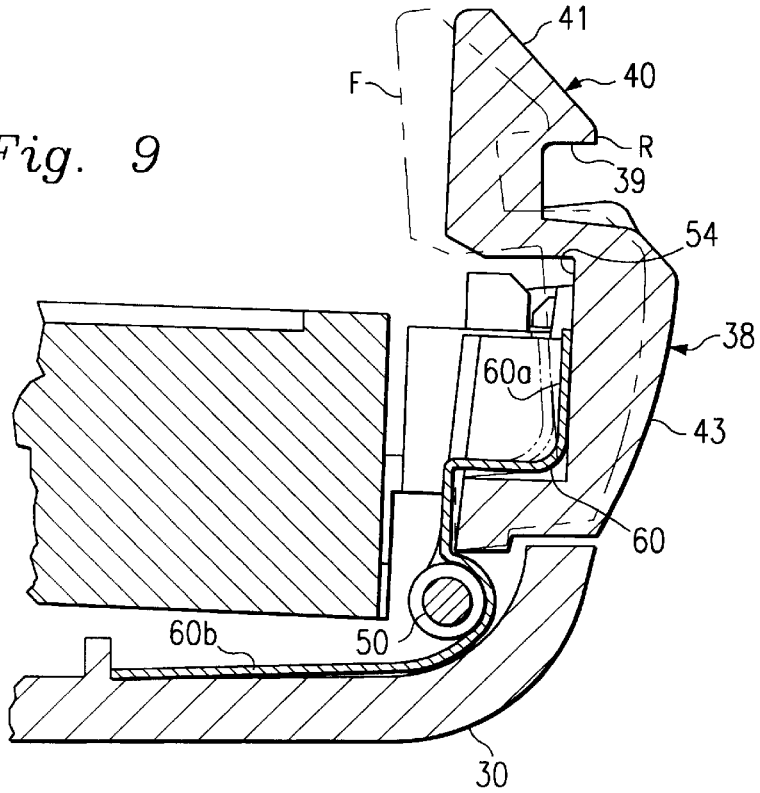
FIG. 9 is a partial cross-sectional view of the latch taken along line 9—9 of FIG. 7.

In another view, latch 38, FIG. 7, is mounted in lid 30 adjacent LCD panel 36. Hook 40 protrudes from top 44 of latch 38, and flexible snap-in members 52*a*, 52*b*, engage latch mounts 62*a*, 62*b*, respectively. In FIG. 8, a cross-sectional view illustrates latch 38 mounted in lid 30 adjacent LCD panel 36, and hook 40 extends into engagement with base 28. Also, in FIG. 9, the movement of latch 38 is illustrated. Latch 38 pivots about spring retaining member 50 due to resistance of spring 60 including first portion 60*a* engaging front face 54 of latch 38 and second portion 60*b* engaging lid 30. In this manner, hook 40 is moved between an at rest position R to a flexure position F.

In operation, spring 60 is mounted in latch 38 by engaging intermediate portion 60*c* with spring retaining member 50. In this position, first portion 60*a* of spring 60 is engaged with front face 54 of latch 38. Latch 38 is mounted in lid 30 by inwardly flexing the flexible snap-in members 52*a*, 52*b* between latch mounts 62*a*, 62*b* respectively. Release of the snap-in flexible members 52*a*, 52*b* when buttons 64*a*, 64*b* are aligned with apertures 66*a*, 66*b*, respectively, permits the buttons 64*a*, 64*b* to be engaged in the respective apertures 66*a*, 66*b*. This positions second section 60*b* of spring 60 in engagement with a portion of lid 30.

When lid 30 is closed into the N position nested with base 30, hook 40 is deflected from position R to position F against the force of spring 60 and snaps into engagement with receiver 42 of base 28. Such flexure is caused by sloped surface 41 of hook 40 engaging receiver 42 of base 28. When sloped surface 41 clears the receiver 42, the hook 40 snaps back into position R so that ledge 39 engages base 28 and thus secures lid 30 in engagement with base 28. When it is desired to open lid 30 from nested position N to open position O, manual pressure applied to surface 43 of latch 38, urges hook 40 from position R to position F. As a result, hook 40 can clear receiver 42 and lid 30 can be rotated from nested position N to open position O.

If necessary, removal of latch 38 is accomplished by flexing inwardly, the snap-in flexible members 52*a*, 52*b* until buttons 64*a*, 64*b* are withdrawn from respective apertures 66*a*, 66*b*, thus permitting latch 38 to be withdrawn from lid 30.

As it can be seen, the principal advantages of these embodiments are that the latch may remain small and incorporate an increased spring force. The increased spring force is provided with a spring member which is durable and reliable. The latch is easily snapped into and out of the lid which is advantageous during manufacture and also during repair or replacement. Also, even with the increased spring force, the latch is easily releasable by the application of manual pressure when the laptop lid is to be opened.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A latch apparatus for mounting in a host receiver comprising:

a latch member having a top, a bottom, a front face, opposite sides, and a groove formed therein adjacent a first one of the sides;

a hook member protruding from the top of the latch member;

a spring retaining member positioned adjacent the bottom of the latch member, the spring retaining member extending between the opposite sides;

a rib member extending along the front face between the opposite sides and adjacent the spring retaining member;

a flexible snap-in member adjacent the first side, the snap-in member being flexible away from the first side and into the groove; and a spring member being retained in the latch member by a first contoured portion for receiving the rib member and a second contoured portion for receiving the spring retaining member.

2. A laptop computer comprising:

a base member;

a lid pivotally connected to the base member;

a latch member mounted in the lid member, the latch member having a top, a bottom, a front face, opposite sides, and a groove formed adjacent each of the opposite sides;

a hook member protruding from the top of the latch member;

a spring retaining member positioned adjacent the bottom of the latch member;

a rib member extending along the front face between the opposite sides and adjacent the spring retaining member;

a pair of flexible snap-in members for engagement with the lid, a first one of the flexible snap-in members being positioned on a first one of the sides adjacent a first one of the grooves, and a second one of the flexible snap-in members being positioned on a second one of the sides adjacent a second one of the grooves, the spring retaining member extending between the grooves; and a spring member being retained in the latch member by a first contoured portion for receiving the rib member and a second contoured portion for receiving the spring retaining member.

3. The laptop computer as defined in claim 2 wherein the base member includes a receiver formed therein for receiving the hook member.

4. The laptop computer as defined in claim 2 wherein the pair of flexible snap-in members extend substantially parallel to each other.

5. A computer system comprising:

a laptop computer housing;

a microprocessor in the computer housing;

an input coupled to provide input into the microprocessor;

a mass storage coupled to the microprocessor;

a display coupled to the microprocessor by a video controller;

a memory coupled to provide storage to facilitate execution of computer programs by the microprocessor;

the laptop computer housing including a base member and a lid member pivotally connected to the base member;

a latch member mounted in the lid member, the latch member having a top, a bottom, a front face, opposite sides, and a groove formed therein adjacent a first one of the sides;

a hook member protruding from the top of the latch member;

a spring retaining member positioned adjacent the bottom of the latch member;

a flexible snap-in member adjacent the first side for engagement with the lid member, the snap-in member being flexible away from the first side and into the groove; and a spring member being retained in the latch member by a first contoured portion for receiving the rib member and a second contoured portion for receiving the spring retaining member.

6. The computer system as defined in claim 5 wherein the base member includes a receiver formed therein for receiving the hook member.

7. A method of mounting a latch member in a lid of a laptop computer comprising the steps of:

forming a latch member with a top, a bottom, a pair of opposite sides, and a front face;

forming a groove in the latch member adjacent each of the opposite sides;

forming a hook member to protrude from the top of the latch member;

forming a pair of flexible snap-in members, one on each of the opposite sides adjacent a respective one of the grooves, the snap-in members being substantially parallel to each other;

forming a spring retaining member adjacent the bottom of the latch, the spring retaining member extending between and transverse to the snap-in members;

extending a rib member along the front face and adjacent the spring retaining member;

mounting a spring member in the latch member so that a first contoured portion of the spring member receives the rib member and a second contoured portion of the spring member receives the spring retaining member for retaining the spring member on the latch member; and flexing the snap-in members towards each other into their respective grooves so that they engage snap supports provided in the lid, and so that the latch member and spring member are snapped into the lid as a unit.

* * * * *